US010072416B2

(12) United States Patent
Armbrust et al.

(10) Patent No.: US 10,072,416 B2
(45) **Date of Patent: *Sep. 11, 2018**

(54) TUBULAR JOIST STRUCTURES AND ASSEMBLIES AND METHODS OF USING

(71) Applicants: Scott F. Armbrust, Apple Valley, MN (US); Scott A. Armbrust, Edmund, OK (US)

(72) Inventors: Scott F. Armbrust, Apple Valley, MN (US); Scott A. Armbrust, Edmund, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/708,043

(22) Filed: Sep. 18, 2017

(65) Prior Publication Data

US 2018/0094435 A1 Apr. 5, 2018

Related U.S. Application Data

(63) Continuation-in-part of application No. 14/214,595, filed on Mar. 14, 2014, now Pat. No. 9,765,520.

(51) Int. Cl.
*E04B 1/24* (2006.01)
*E04C 3/04* (2006.01)
(Continued)

(52) U.S. Cl.
CPC ..... *E04C 3/08* (2013.01); *E04B 1/2403* (2013.01); *E04B 5/10* (2013.01); *E04B 7/022* (2013.01);
(Continued)

(58) Field of Classification Search
CPC ..... E04C 3/02; E04C 3/04; E04C 3/08; E04C 2003/0486; E04C 2003/0491; E04C 2003/0465; E04B 5/10; E04B 7/22
See application file for complete search history.

(56) References Cited

U.S. PATENT DOCUMENTS 1,924,880 A 8/1933 Ragsdale
2,514,607 A 7/1950 McLean
(Continued)

FOREIGN PATENT DOCUMENTS

JP 09125521 A 5/1997

OTHER PUBLICATIONS

OSHA 29 CFR 1926.751 https://www.osha.gov/pls/oshaweb/owadisp.show_document?p_table=STANDARDS&p_id=10787; United States Department of Labor.

*Primary Examiner* — Christine T Cajilig

(57) ABSTRACT

A tubular joist structure. The joist structure includes a tubular top chord; a tubular bottom chord; and, a plurality of diagonals extending between the tubular top chord and the tubular bottom chord. The diagonals may also be tubular. The diagonals are arranged in a zig-zag formation between the tubular top chord and the tubular bottom chord. A doubler plate may be affixed to the bottom surface of the top chord and/or the top surface of the bottom chord such that at least one of the diagonals is affixed to the doubler plate. The joist structure may include at least two joist segments spliced together. A method of constructing a joist assembly includes assembling at least two joist segments each including a top chord, a bottom chord, and a plurality of diagonals extending between the top chord and bottom chord and splicing the joist segments together to form a joist structure.

20 Claims, 10 Drawing Sheets

(51) Int. Cl.

| | |
|---|---|
| ***E04C 3/08*** | (2006.01) |
| *E04B 5/10* | (2006.01) |
| *E04B 7/02* | (2006.01) |
| *E04C 3/02* | (2006.01) |

(52) U.S. Cl.
CPC ..... *E04B 2001/2415* (2013.01); *E04B 2001/2448* (2013.01); *E04B 2103/06* (2013.01); *E04C 2003/026* (2013.01); *E04C 2003/0439* (2013.01); *E04C 2003/0491* (2013.01)

(56) References Cited

U.S. PATENT DOCUMENTS

| | | | | |
|---|---|---|---|---|
| 3,019,861 | A | | 2/1962 | Rasch et al. |
| 3,058,549 | A | | 10/1962 | Anderson |
| 3,129,493 | A | | 4/1964 | Grubb |
| 3,131,791 | A | | 5/1964 | Davis, Jr. et al. |
| 3,131,794 | A | | 5/1964 | Bender |
| 3,314,209 | A | | 4/1967 | Troutner |
| 3,708,928 | A | | 1/1973 | Gaspers |
| 3,785,109 | A | | 1/1974 | Letourneur |
| 3,826,057 | A | | 7/1974 | Franklin |
| 4,253,210 | A | | 3/1981 | Racicot |
| 4,489,659 | A | * | 12/1984 | Kamohara ..... B66C 23/70 104/107 |
| 4,543,008 | A | | 9/1985 | Salama et al. |
| 4,912,903 | A | | 4/1990 | Mogami et al. |
| 5,435,110 | A | | 7/1995 | Stol et al. |
| 5,437,135 | A | | 8/1995 | Witte |
| 5,761,873 | A | | 6/1998 | Slater |
| 5,794,398 | A | | 8/1998 | Kaehler et al. |
| 5,802,772 | A | | 9/1998 | Burke et al. |
| 6,205,736 | B1 | | 3/2001 | Amborn et al. |
| 6,237,299 | B1 | | 5/2001 | Gortan |
| 6,993,880 | B2 | | 2/2006 | Cameron et al. |
| 8,627,633 | B2 | | 1/2014 | Davies |
| 8,800,238 | B2 | | 8/2014 | Davies |
| 8,851,096 | B2 | | 10/2014 | De Villenfagne De Sorinnes et al. |
| 8,910,447 | B2 | | 12/2014 | Wallther |
| 8,978,338 | B2 | | 3/2015 | Jobin et al. |
| 2004/0003550 | A1 | | 1/2004 | Konopka |
| 2006/0101646 | A1 | | 5/2006 | Jhang |
| 2008/0196320 | A1 | | 8/2008 | Weinberg |
| 2009/0019811 | A1 | | 1/2009 | Goldman |
| 2010/0043329 | A1 | | 2/2010 | Dagg |
| 2010/0326003 | A1 | | 12/2010 | Davies |
| 2013/0291477 | A1 | | 11/2013 | Jobin et al. |

* cited by examiner

TUBULAR JOIST STRUCTURES AND ASSEMBLIES AND METHODS OF USING

CROSS REFERENCE TO RELATED APPLICATION

This application is a Continuation-in-Part of U.S. patent application Ser. No. 14/214,595 entitled "TUBULAR JOIST STRUCTURES AND ASSEMBLIES AND METHODS OF USING" filed Mar. 14, 2014 which claims the benefit of U.S. Provisional Application No. 61/784,615 filed Mar. 14, 2013, herein incorporated by reference in their entirety for all purposes.

FIELD OF THE INVENTION

The present invention relates, generally, to materials used in construction. More specifically, the present invention relates to steel joist structures used in building construction.

BACKGROUND OF THE INVENTION

Steel joists have been used to structurally support building roofs and floors throughout the United States for the better part of a century. An exemplary array of conventional joists forming a support for a deck or roof is depicted in FIG. 1. The term "joist", as used herein, indicates a closely spaced, repetitive member that directly supports (and in combination directly supports) a relatively flat structural element such as a roof deck or floor slab or the like. A steel joist, as opposed to a common truss, is defined by the U.S. Department of Labor in OSHA 29 C.F.R. § 1926, Subpart R, incorporated fully herein by reference. Joists of identical properties are commonly found in a building in relatively large numbers, and as a result, such joists are currently manufactured in mass quantities. In contrast to the joist, a "girder" is a relatively heavier member that are fewer in number and that directly supports the joists.

The conventional steel joist used today consists of a top chord, a bottom chord, and multiple diagonals. As FIG. 2 indicates, the top chord is a horizontal (or slightly sloped) member that in typical conditions fastens directly to the corrugated metal roof or floor deck that is being supported. The bottom chord is a horizontal member that is beneath and parallel (or nearly parallel) to the top chord. The diagonals (also known as web members) are inclined members arranged in a zig-zag pattern to join the top chord to the bottom chord. All of these members lie in, or nearly in, a common vertical plane.

The top chord of today's conventional steel joist consists of a pair of steel angles, parallel to one another, and positioned in a "back-to-back" orientation. See FIG. 3. The bottom chord also uses this same configuration. The web members are typically fabricated from steel angles or steel rods and are frequently welded in the gap between the parallel steel angles of the top (and bottom) chord.

Well known problems associated with present conventional steel joist constructions include: 1.) the need for erection bracing, also known as erection bridging as defined by OSHA; 2.) poor aesthetics; 3.) potential for corrosion of untreated areas; 4.) proclivity to top and/or bottom chord local bending; 5.) poor power actuated fastener penetration due to top chord local bending; 6.) inability to properly support/distribute and/or aesthetically conceal electrical and plumbing lines and HVAC ductwork. A need, therefore, exists for a steel joist assembly which resolves or greatly reduces these known problems.

SUMMARY OF THE INVENTION

The present invention is a substantially hollow tubular joist structure, a joist assembly including a plurality of aligned repetitive tubular joist structures, and a method of constructing this joist assembly. The tubular joists are preferably steel. Tubular joists offer several advantages over conventional steel joists. The tubular joists of the present disclosure are designed to fully comply with OSHA 29 C.F.R. § I926.757(a)(3), incorporated fully herein by reference.

Steel joists have never been fabricated primarily from hollow steel tubes. These hollow steel tubes may include, by way of example and without limitation, a square, rectangular, round, oval, diamond shape, or hexagonal cross-section, however, it is understood that any suitable geometry could be employed as may be suitable for a particular application or known or developed by one of skill in the art. Preferred geometries may include round, square (including substantially square such as square with rounded or truncated corners), or rectangular (also perhaps with rounded or truncated corners) with rectangular or substantially rectangular being the most preferred cross-section. These hollow tubes (most preferably steel but may be constructed of any suitable material) shall be referred to herein as "tubular." Joists constructed using tubular chords which may also include tubular diagonals shall be referred to herein as "tubular joists".

The joist structure of the present disclosure includes a tubular top chord; a tubular bottom chord; and, a plurality of diagonals extending between the tubular top chord and the tubular bottom chord. The diagonals are also, in a preferred arrangement, tubular in construction. The diagonals are preferably arranged in a zig-zag formation between the tubular top chord and the tubular bottom chord.

The tubular top chord may be capable of receiving a power actuated fastener (PAF). The tubular top chord and the tubular bottom chord are capable of receiving a utility conduit. A utility conduit may include an electrical conduit or cable, a plumbing conduit, or it may receive a HVAC duct or may even itself act as an HVAC duct to convey conditioned air.

A method of constructing a tubular joist includes arranging a tubular top cord and a tubular bottom chord in a nearly or substantially parallel relationship. The tubular top chord and tubular bottom chord support one another through a plurality of diagonals which extend between the tubular top chord and tubular bottom chord in a preferred, substantially zig-zag manner. The diagonal are fastened to the tubular top chord and the tubular bottom chord preferably by welding or using fasteners or by any other means or as known in the art.

Tubular joists of short to moderate length are typically fabricated in a shop and shipped as a single unit to the field to be incorporated into a Tubular Joist Structure. Longer tubular joists that are too long to economically ship as a single unit are typically fabricated in a shop in two or more joist segments (sub-pieces) that are individually shipped and subsequently connected, or "spliced", together in the field. In this case each chord and one or more diagonals may be bifurcated by, or augmented with, connection splice material that accommodates the splice connections that must be accomplished in the field. FIG. 13 depicts an exemplary joist with connection splice material allowing the sub-pieces to be spliced together in the field. Other variations are contemplated and would be apparent to one of ordinary skill in the art.

A joist structure having a span for spanning between a first support and a second support and having a center of gravity. The joist structure includes a singular tubular top chord having a continuously closed, non-adjustable length and a singular tubular bottom chord having a continuously closed, non-adjustable length. A plurality of discrete diagonal segments are each welded and extend between the tubular top chord and the tubular bottom chord such that the top chord is spaced from the bottom chord by the plurality of discrete diagonal segments. The top chord, diagonal segments, and bottom chord together form a height of the joist structure. The joist structure spans and is configured to be secured to the first support and the second support at points that are higher than the center of gravity of the joist structure. The length of the top chord and the length of the bottom chord together with said plurality of diagonal segments forming a secondary structural member which is dimensioned to support at least 250 pounds located anywhere along the joist without requiring any erection bracing or bridging for a span of at least 24 times the height of the joist structure.

The joist structure top chord may further have a bottom surface and a plurality of doubler plates welded to the bottom surface of top chord. At least a portion of the diagonal segments may be welded to a doubler plate. The joist structure bottom chord may also have a plurality of doubler plates welded to the top surface of the bottom chord. At least one of the diagonal segments may be welded to the doubler plate. The joist structure of claim 1 further comprising top chord having a bottom surface; a plurality of doubler plates welded to bottom surface of top chord; bottom chord having a top surface; a plurality of doubler plates welded to top surface of the bottom chord.

The present disclosure further includes a joist structure having a span for spanning between a first support and a second support and having a center of gravity. The joist structure includes a singular tubular top chord having a continuously closed, non-adjustable length and a singular tubular bottom chord having a continuously closed, non-adjustable length. A plurality of discrete diagonal segments are each welded and extending between the tubular top chord and the tubular bottom chord such that the top chord is spaced from the bottom chord by the plurality of discrete diagonal segments. The top chord, diagonal segments, and bottom chord together form a height of the joist structure. The joist structure spans and is configured to be secured to the first support and the second support at points that are higher than the center of gravity of the joist structure. The length of the top chord and the length of the bottom chord together with said plurality of diagonal segments forming a secondary structural member which is dimensioned to support at least 250 pounds located anywhere along the joist without requiring any erection bracing or bridging for a span of at least 24 times the height of the joist structure. The joist structure may also include at least two joist segments spliced together to form the joist structure.

The plurality of diagonals are preferably arranged in a zig-zag formation between the tubular top chord and the tubular bottom chord. The joist segments are spliced together by fastening together splice plates affixed to adjoining ends of the joist segments. A plurality of joist structures may be aligned substantially parallel to form an assembly capable of supporting a structural element.

The tubular top chord is capable of receiving a power actuated fastener. The tubular top chord or the tubular bottom chord are preferably capable of receiving a utility conduit.

A method of constructing a joist structure capable of supporting a structural element includes assembling a joist segment having a singular top sub-chord and a singular bottom sub-chord, by welding a plurality of tubular diagonal segments between the top sub-chord and the bottom sub-chord. The plurality of tubular diagonal segments each including a first open end and a second open end wherein the first open end is welded to the top chord or doubler plate and the second open end is welded to the bottom chord or doubler plate. The joist segments are spliced together to form the joist structure of the present disclosure. The joist structure includes a top chord having a continuously closed top chord tube having a cross-section of constant outside perimeter length and shape and a continuously closed tubular bottom chord tube having a cross-section of constant outside perimeter length and shape. The joist structure forms a secondary structural member. A length of the top chord and a length of the bottom chord together with the plurality of diagonal segments forms the secondary structural member which is dimensioned to support at least 250 pounds located anywhere along the joist without requiring any erection bracing or bridging for a span of at least 24 times a height of the joist structure. In the method at least one of the diagonal segments may be bifurcated. The bifurcated sections may then be spliced together. A plurality of joist structures of the present disclosure may be assembled together to form the secondary structural member.

DETAILED DESCRIPTION OF THE PREFERRED EMBODIMENTS

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention.

Figure 3A:
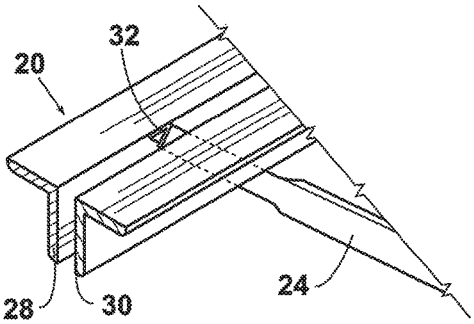
Fig. 3A ( PRIOR ART )
FIG. 3A depicts a conventional steel top chord construction.
Figure 3B:
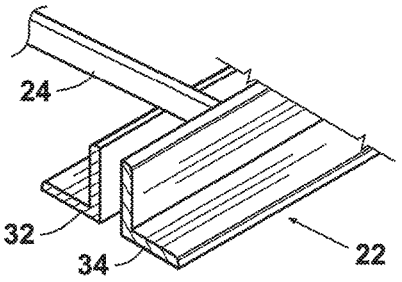
Fig. 3B ( PRIOR ART )
FIG. 3B depicts a conventional steel bottom chord construction.
Figure 2:
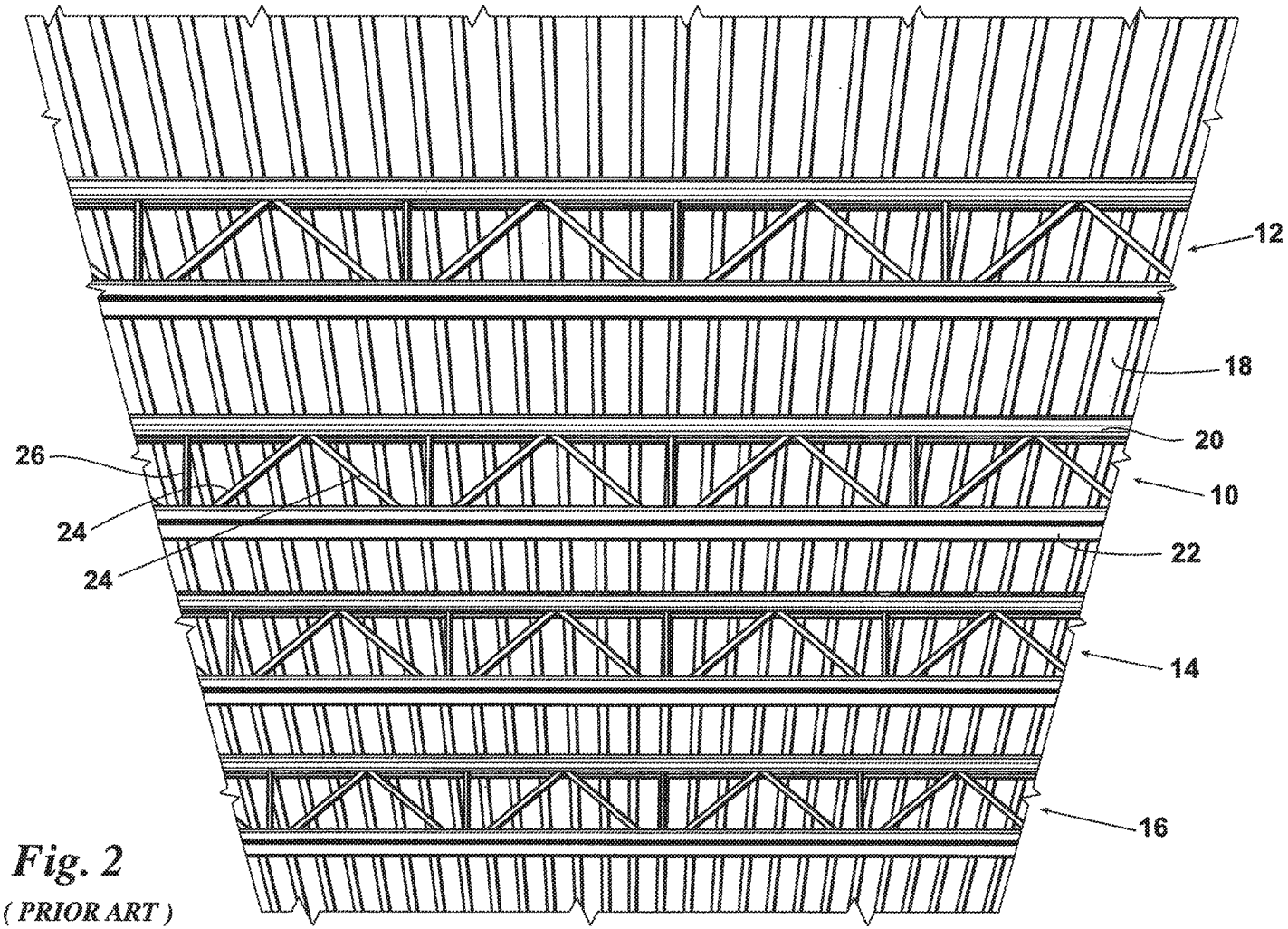
Fig. 2 ( PRIOR ART )
FIG. 2 depicts a prior art joist top chord, joist bottom chord, and joist diagonals.

With reference to FIG. 2 in combination with FIGS. 3A and 3B, a conventional steel joist 10 generally includes a top chord 20, a bottom chord 22 and multiple diagonals 24. A plurality of joists 12, 14, and 16 identical to joist 10 are depicted in FIG. 2 supporting a corrugated metal roof deck 18. Top chord 20 is a horizontal (or slightly sloped) member that in typical conditions fastens directly to corrugated metal roof 18 or to a floor deck in an alternate application. FIG. 3A depicts top chord 20 which includes two opposed steel angles 28 and 30. Diagonal 24 extends between steel angles 28 and 30. Diagonal 24 is depicted to include a crimped end 32 which is sandwiched and welded between opposed angles 28 and 30.

Bottom chord 22 is a horizontal member that is beneath and parallel (or nearly parallel) to top chord 20. With reference to FIG. 3B, bottom chord 22 is depicted. Bottom chord 22 is comprised commonly of up to two steel angles 32 and 34. Diagonal 24, as with top chord 20, frequently includes a crimped end which is sandwiched between steel angles 32 and 34 and typically welded therein.

The diagonals 24 (FIG. 2) are also commonly referred to as web members and are inclined members arranged in a zig-zag pattern to join top chord 20 to bottom chord 22. The diagonal members 24 are typically fabricated from steel angles or steel rods and welded between the steel angles of the top chord 20 and the bottom chord 22. Top chord 20, diagonals, collectively 24, and bottom chord 22 are typically configured to be in a common vertical plane.

Figure 1:
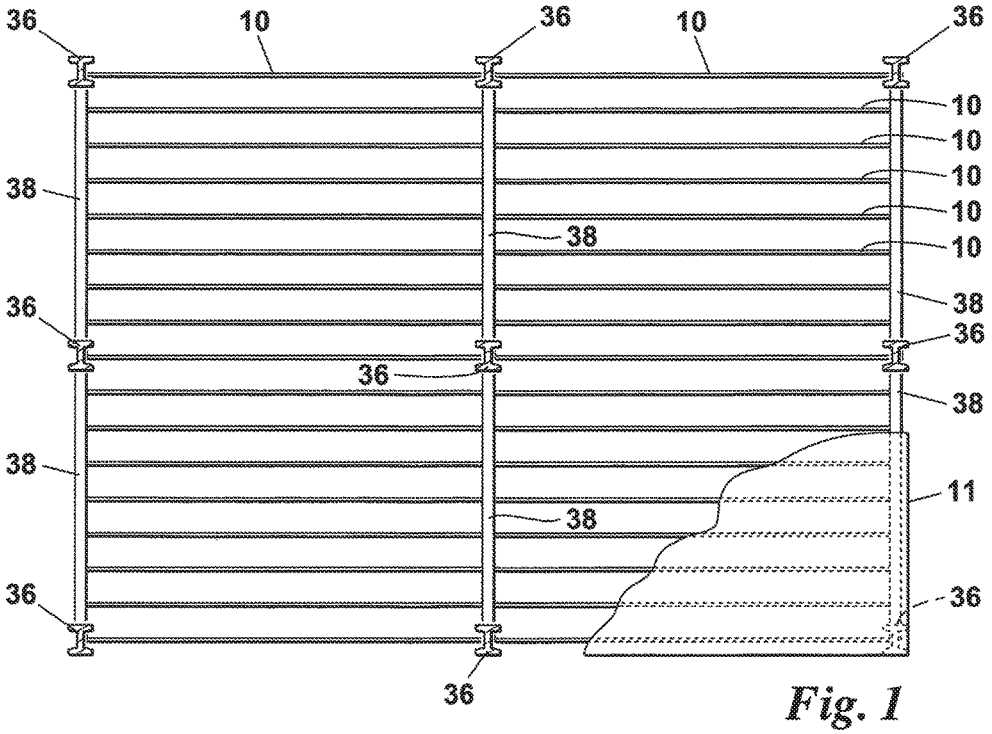
Fig. 1 ( PRIOR ART )
FIG. 1 depicts a typical prior art floor or roof plan view showing joists, girders, and columns.

FIG. 1 depicts a conventional array of conventional open-web joists 10 forming a support for a deck or roof 11 shown partially cut-away. Vertical building columns 36 support a plurality of girders 38. Girders 38, in turn, support joists 10. In the exemplary array depicted in FIG. 1, nine building columns 36 support six girders 38 to which thirty-four joists 10 are secured.

Figures 10, 11, 12:
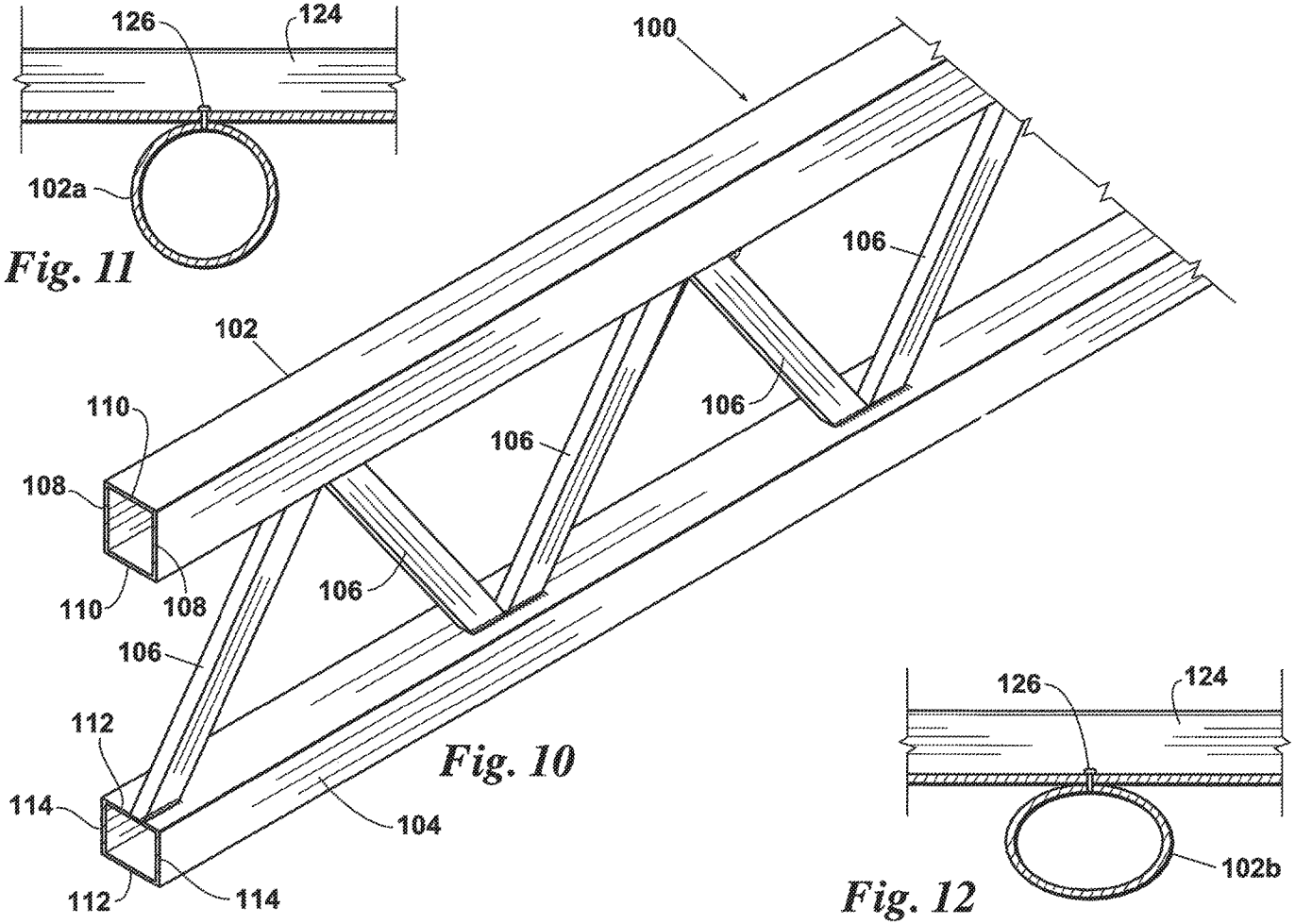
FIG. 10 depicts an isometric view of a tubular joist assembly of the present disclosure.
FIG. 11 depicts a partially cut away view of a tubular joist assembly of the present disclosure depicting a substantially round cross-section.
FIG. 12 depicts a partially cut away view of a tubular joist assembly of the present disclosure depicting a substantially oval cross-section.

FIG. 10 depicts a tubular joist construction of the present disclosure which is contemplated to replace joists 10 in applications such as depicted in FIG. 1. With reference to FIG. 10, tubular joist 100 includes a tubular top chord 102 and a tubular bottom chord 104 connected by diagonals 106. In the preferred embodiment depicted in FIG. 10, top chord 102 includes a length of tubular steel, preferably high strength (HSS) with a substantially rectangular cross section. In this embodiment top chord 102 is oriented such that the longer sides 108 of the rectangular cross section are oriented substantially vertically while the shorter sides 110 are oriented substantially horizontally.

Bottom chord 104 includes a length of tubular steel the same construction as top chord 102 and positioned parallel to top chord 102 and separated by diagonals 106. In the preferred arrangement depicted in FIG. 10, bottom chord 104 includes substantially the same rectangular geometry in cross section as is top chord 102. However, in this embodiment, the longer sides of the rectangular cross section 112 are positioned horizontally while the shorter sides 114 are positioned vertically. It should be understood that the embodiment depicted in FIG. 10 is exemplary such that tubular top chord 102 and tubular bottom chord 104 could have the same or different cross sectional geometries or orientations from one another or could be oriented in any desired manner. Alternatively, it is conceivable that top chord 102 could be replaced with a conventional top chord design, such as 20 of FIG. 3A such that only bottom chord 104 is tubular. Likewise bottom chord 104 could alternatively be replaced with a conventional bottom chord design, such as 22 of FIG. 3B such that only top chord 102 is tubular.

Diagonals 106 connect tubular top chord 102 and tubular bottom chord 104. In the preferred arrangement, diagonals 106 are also steel tubular construction also with a rectangular cross section but of a smaller size than tubular top chord 102 and tubular bottom chord 104. However, it is understood that diagonals 106 could be constructed of any suitable geometry. Alternatively, diagonals 106 could be of a conventional construction and not tubular. Diagonals 106 in the preferred arrangement are oriented in a zig-zag pattern to join tubular top chord 102 and tubular bottom chord 104. Diagonals 106 are welded to top chord 102 and bottom chord 104 in one embodiment, thus forming a rigid open web tubular joist design. Tubular top chord 102, tubular bottom chord 104 and diagonals 106, when constructed lie in, or nearly in, a common vertical plane.

Figure 17:
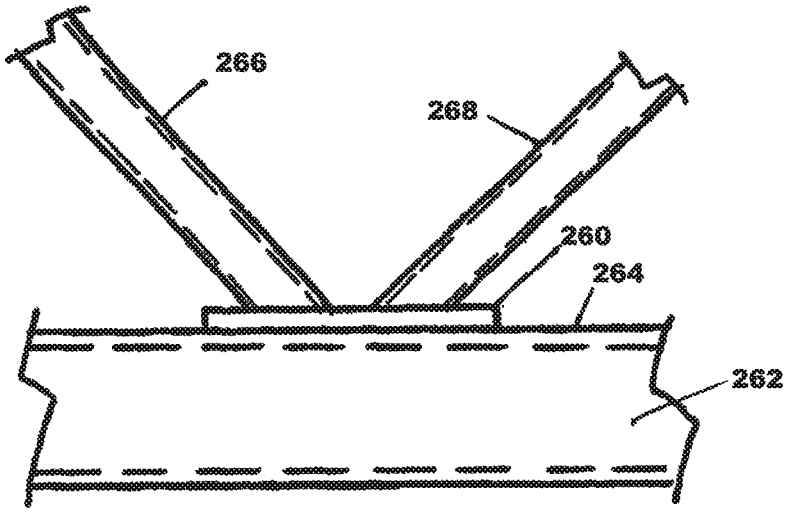
FIG. 17 depicts the joist structure of the present disclosure including a doubler plate welded to the bottom chord.
Figure 18:
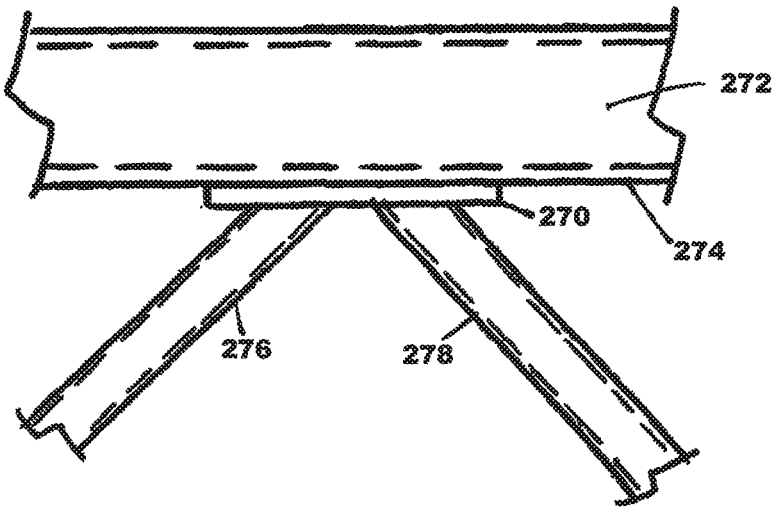
FIG. 18 depicts the joist structure of the present disclosure including a doubler plate welded to the top chord.

In an alternate preferred embodiment, with reference to FIGS. 17 and 18, a doubler plate 260 may be affixed (such as by welding or other known manner of fastening) to the top surface 264 of bottom chord 262. In this way, doubler plate

260 becomes a part of bottom chord 262. In this embodiment, one or at least a plurality of diagonal segments 266 and 268 may be affixed to doubler plate 260 for additional rigidity.

Likewise, with specific reference to FIG. 18, a doubler plate 270 may be affixed (such as by welding or other known manner of fastening) to the bottom surface 274 of top chord 272. In this way, doubler plate 270 becomes a part of top chord 272. In this embodiment, one, or at least a plurality of diagonal segments 276 and 278 may be affixed (weld or other suitable method) to doubler plate 260 to provide additional rigidity.

Tubular joists offer several advantages over conventional steel joists. Specifically, nine such advantages have been identified and are set forth herein. For example, with regard to fabrication, tubular joists have several advantages. Tubular joists have half the number of chord pieces, and one-third fewer web member pieces (no verticals) to handle and cut in the shop. Tubular joists will have less than half the surface area that must be coated. All web-to-chord tubular connections are simple gapped joints with small fillet welds made on the flat area of the HSS tube wall.

Figure 4A:
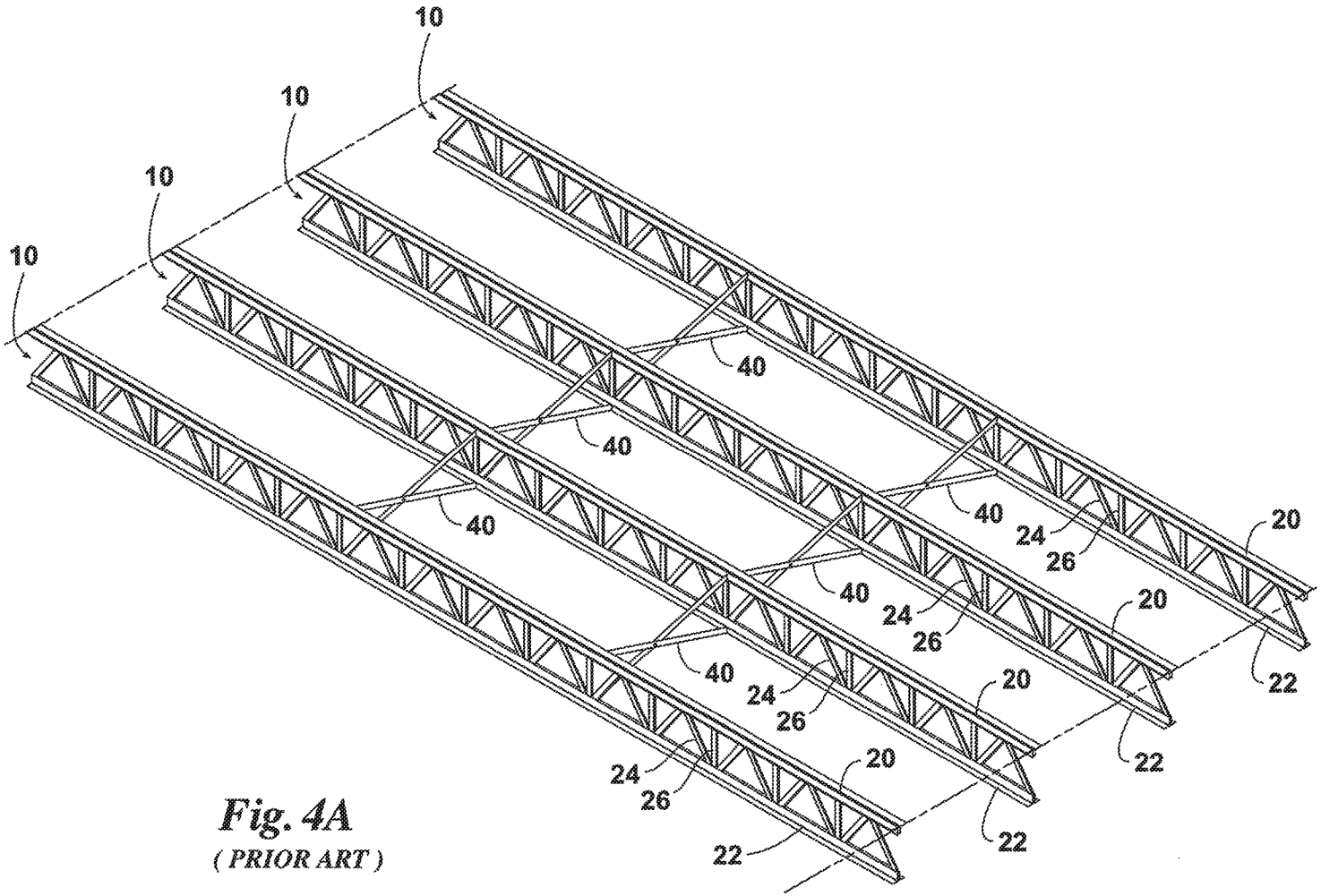
Fig. 4A ( PRIOR ART )
FIG. 4A is a perspective view of a prior art joist assembly requiring erection bracing.

Advantage 1: Erection Bracing:

With reference to FIG. 4A, conventional joist chords 20, 22, consisting of a pair of steel angles, offer relatively little resistance against torsion (i.e., twist). The chord's resistance to torsion, or lack thereof, heavily influences a joist's tendency to laterally buckle under the weight of an iron worker. Consequently, since conventional joists 10 lack torsional resistance they are prone to lateral buckling. As a result, the United States Occupational, Health, and Safety Administration (OSHA) has strict rules, for joists exceeding certain lengths, that require the crane lifting assembly (e.g., the crane hook) to remain connected to the joist until after "erection bridging" is installed. "Erection bridging" 40 typically consists of bracing members that laterally support the joist 10 and prevent lateral buckling under the weight of an iron worker. It is typically provided in a "X" brace configuration (FIG. 4A). As elaborated below, a comparable tubular joist offers superior torsional resistance, leading to greater stability against lateral buckling.

The torsional constant "J", which is a property of the member cross section, directly impacts the member's effectiveness in resisting torsion: the greater "J", the greater the resistance against torsion. The following comparison contrasts a conventional top chord 20 (FIG. 3A) consisting of ¼" thick angles with 4" long legs and a ¾" gap between the angles, and a comparable tubular chord:

Conventional chord 20, J=0.088 $in^4$.

A Square tubular chord 118 (FIG. 4B) of the present disclosure, having equivalent weight (4" square, 0.2586" thick): J=13.54 $in^4$.

Figure 4B:
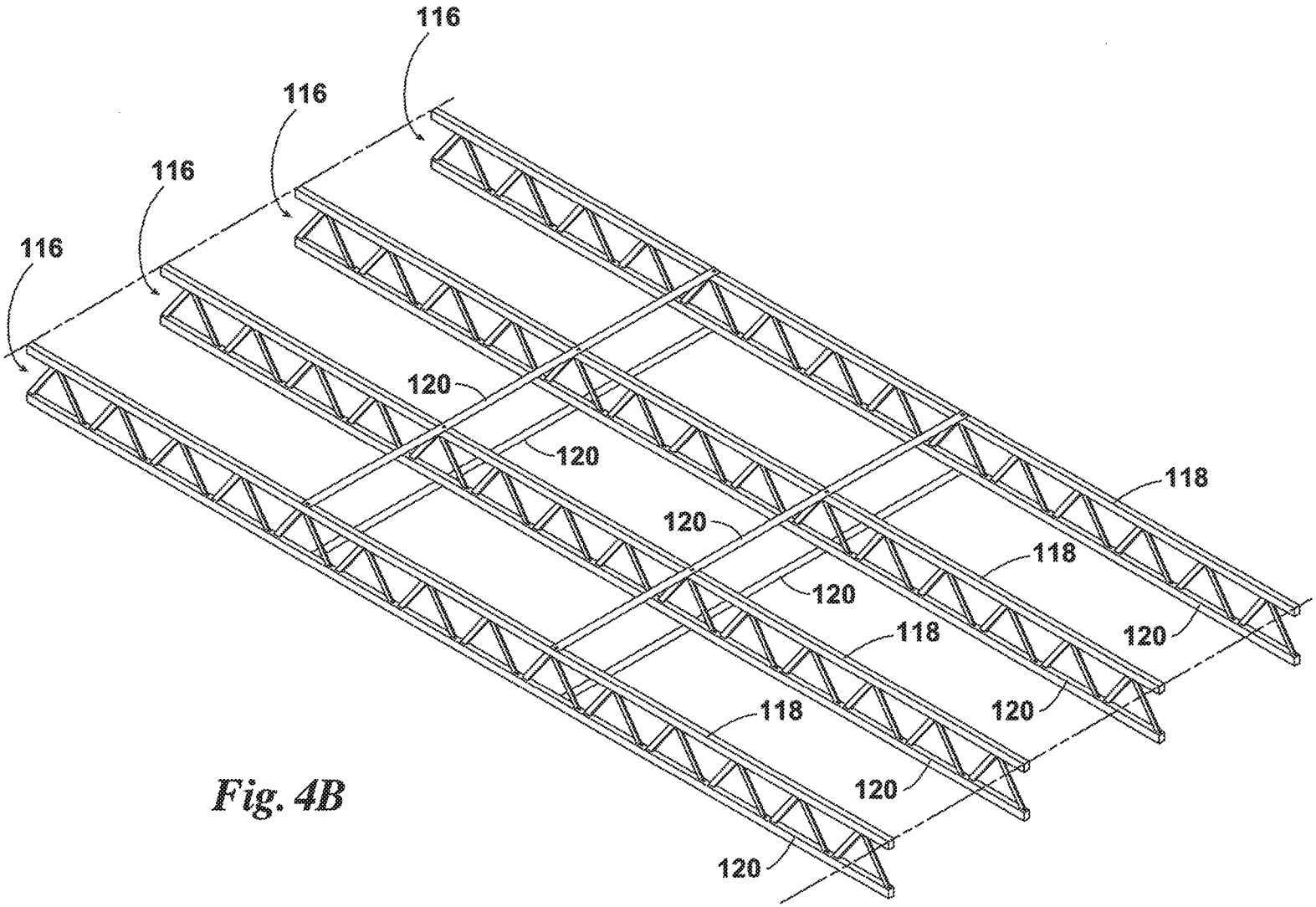
FIG. 4B is a perspective view of the tubular joist assembly of the present disclosure requiring only horizontal bracing.

Hence, the tubular chord 118 (FIG. 4B) offers a torsional constant that is 150 times greater than the conventional joist chord 10. The same would be true for a comparison of a conventional bottom chord 22 (FIG. 4A) and a square tubular chord 120 (FIG. 4B). The efficiency offered by tubular joist 118 dramatically reduces the joist's tendency to buckle and can reduce, and in most cases, eliminate the need for erection bridging (40 of FIG. 4A). This allows the erection bridging to be replaced by simple horizontal bridging 120 (FIG. 4B) that is installed after the crane has released from joist 116. The assembly benefits are two-fold:

workers will be supported by more stable joists, and the erection bridging (bolted X bridging) installation operation will be reduced or eliminated.

According to the erection stability equation that is behind the OSHA erection bridging span tables, an unbraced conventional design (32LH06) joist performs unfavorably compared to an unbraced tubular joist of the present disclosure of equivalent weight & load carrying capacity:

| | Conventional Joist | Tubular Joist |
|---|---|---|
| Allowable span without erection bridging | 40 feet | 90 feet |
| Weight of erector that causes a 40' span to buckle | 100 lbs | 3300 lbs |

This is because the torsional constant of the tubular joist is 130 times greater than that of the conventional joist. As a result, the tubular joist design of the present disclosure would be the first joist to be manufactured in compliance with OSHA 29 C.F.R. § 1926.757(a)(3).

The cost benefits are also two-fold:

crane rental cost savings will accrue from the additional speed of erection that comes from avoiding the delay caused by the crane holding the joist while erection bridging is installed, and Example Crane Savings from Eliminating Bolted X Bridging (BXB)

$$330\ \text{joists} * \frac{2\ BXB\ \text{sets}}{\text{joist}} * \frac{3.7\ \text{min of crane time per set}}{60\ \text{min per hr}} = 40.6\ \text{crane hours}$$

$$40.6\ \text{crane hours} * \frac{\$285}{\text{crane hour}} = \$11{,}568$$

reducing/eliminating the erection bridging will reduce the number of bracing members that must be installed. The example in FIG. 4B shows replacing the erection bridging 40 (FIG. 4A) with horizontal bridging 120 (FIG. 4B) affords the following quantity reductions:

the number of bracing members is reduced by a factor of 3, and the number of bolts is cut in half.

Example Labor Savings from a Typical 150,000 sq. ft. Building Replacing Bolted X Bridging (BXB) with Horizontal Bridging $$1680\ \text{sets of}\ BXB * 2\ \text{men} * \left(\frac{6\ \text{min saved per set}}{60\ \text{min per hr}}\right) = 336\ \text{manhours}$$

$$336\ \text{manhours} * \$46.31\ \text{per hr} = \$15{,}562$$

Advantage 2: Aesthetics:

Conventional steel joists 10 (FIG. 4A) are typically used in areas where aesthetic considerations are secondary. Architecturally, tubular steel joists 116 (FIG. 4B) would usually be preferred over conventional steel joists. Readily available tubular steel joists would increase the market available for steel joist construction.

Advantage 3: Corrosion Reduction:

Conventional steel joist fabrication utilizing a pair 28, 30 and 32, 34 (FIGS. 3A and 3B) of steel angles for each chord 20, 22 results in tight spaces where it is very difficult to adequately weld, leading to rough welds creating water traps. Experience has shown that this difficulty leads to localized areas that are susceptible to corrosion. Consequently, engineers generally do not use conventional steel joists if those joists will be exposed to outside air or otherwise corrosive environments. A tubular joist 100 (FIG. 10) avoids this since all exposed surfaces are accessible to welding and painting. Hence, this attribute of the tubular joist would further increase the market available for steel joist construction.

Figure 5A:
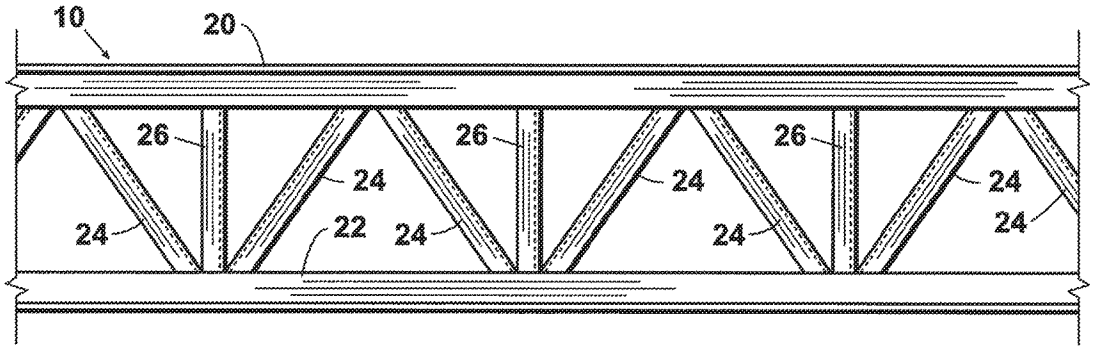
Fig. 5A ( PRIOR ART )
FIG. 5A is a partial side view of a conventional steel joist construction illustrating the need for vertical web members to locally support the top chord to reduce bending stresses.
Figure 5B:
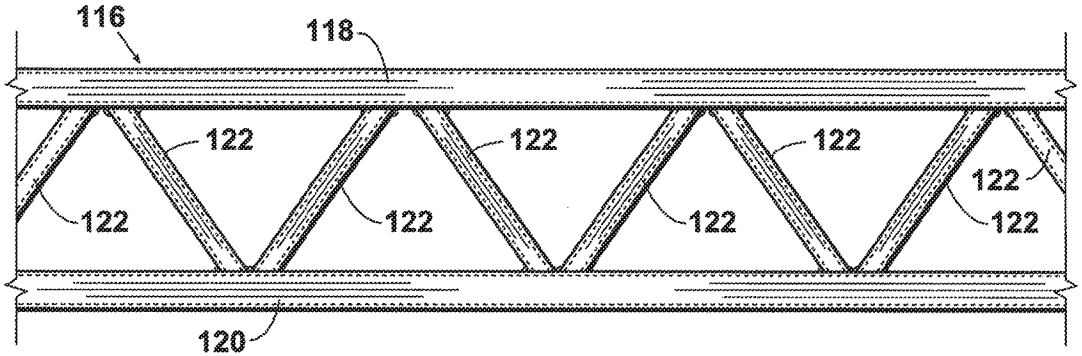
FIG. 5B is a partial side view of a tubular joist assembly of the present disclosure which illustrates the benefits of the top chord local bending strength that allows vertical web members to be eliminated.

Advantage 4: Top Chord Local Bending:

With reference to FIGS. 5A and 5B, the top chord of a tubular joist 116 (FIG. 5B) offers greater strength against local bending than that of a comparable conventional joist 10 (FIG. 5B). The section modulus is a property of the member cross section that is a direct measure of the allowable weight a member can support. If the section modulus is doubled, the allowable supported weight is doubled. Using the same comparison as was done for the torsional constant:

Conventional chord 20 (FIG. 5A), S=2.06 $in^3$

Tubular chord 118 (FIG. 5B) of equivalent weight (4" square, 0.2586" thick); S=2.5 $in^3$.

Hence, an equivalent square tubular chord 118 offers a 21% increase m bending strength over the conventional chord 20. This efficiency offers two cost benefits:

Uniformly distributed roof/floor loading on the top chord 20 of a conventional joist 10 is typically carried by adding a vertical web member 26 to the joist during fabrication (FIG. 5A). This provides support to the otherwise unsupported top chord 20 between the panel points where diagonals 24 attach to chords 20 and 22. The tubular joist 116 (FIG. 5B), since it is stronger in bending avoids this, resulting in fewer web members, Concentrated floor or roof loads often fall on the joist top chord between the panel points. Roof top HVAC units are an example of this. Such conditions will typically require a supplemental reinforcing member to be installed, usually in the field, to support the top chord beneath the concentrated load, A tubular top chord will reduce the number of instances where this reinforcement is required.

Figure 6A:
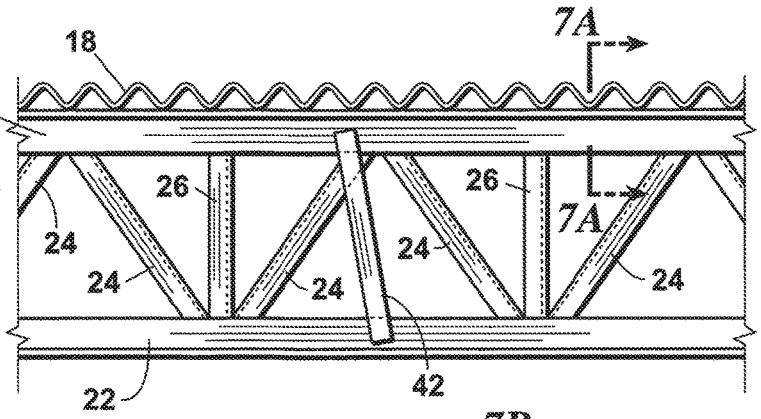
Fig. 6A ( PRIOR ART )
FIG. 6A is a partial side view of a conventional steel joist construction assembly illustrating the need for additional bracing against bottom chord local bending.
Figure 6B:
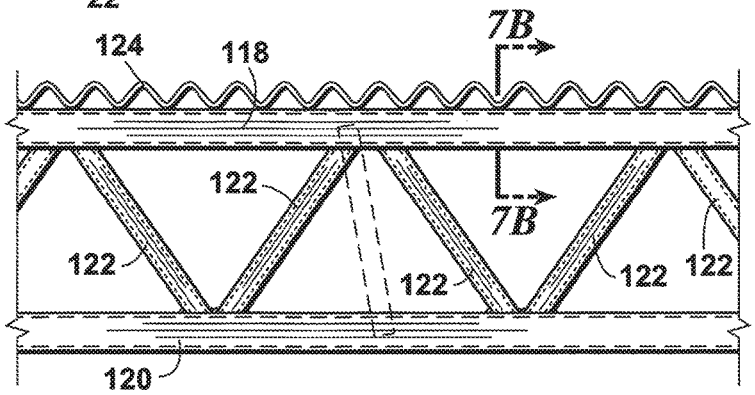
FIG. 6B is a partial side view of a tubular joist assembly of the present disclosure requiring less bracing due to the fact that tubular constructed bottom chords can support heavier local loads.

Advantage 5: Bottom Chord Local Bending:

With reference to FIGS. 6A and 6B, with regard to a conventional steel joist, concentrated hanger loads often fall on the joist bottom chord 22 between the panel points where the diagonals 24 attach to bottom chord 22. HVAC ductwork is an example of this. Such conditions will typically require a reinforcing member 42 to be installed to support the otherwise unsupported length of bottom chord 22 between diagonals 24' and 24' (FIG. 6A) because double angle chords are relatively weak in regard to their ability to withstand bending stresses/forces.

Similar to the top chord comparison, the additional bending strength of an equivalent tubular bottom chord 120 (FIG. 6B) reduces the number of instances where this reinforcing member is (shown in phantom) needed between diagonals 122.

Figure 7B:
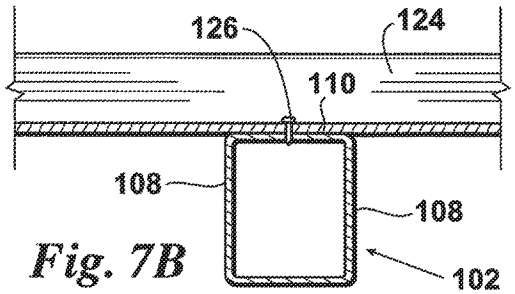
FIG. 7B depicts a partially cut away view, taken along line 7B-7B of FIG. 6B, of a tubular joist assembly of the present disclosure receiving an exemplary power actuated fastener.
Figure 7A:
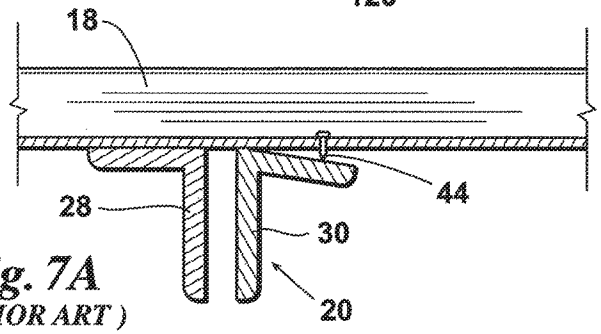
Fig. 7A ( PRIOR ART )
FIG. 7A depicts a partially cut away view, taken along line 7A-7A of FIG. 6A of a conventional steel joist construction illustrating a common problem associated with failure of a power actuated fastener (PAF) to penetrate the top chord of the joist causing local top chord bending.

Advantage 6: Local Bending Preventing PAF Penetration:

Attention is next directed to FIGS. 7A and 7B. First with reference to FIG. 7A a conventional joist construction, power actuated fasteners (PAF) 44 are a relatively new addition to the various alternatives for fastening a corrugated metal deck 18 to the top chord 20 of a joist. PAF's are a fast and often preferred means of attaching the corrugated metal deck 18 to the supporting joists. Conventional joists have been known to bend locally as shown in FIG. 7A, preventing the PAF 44 from penetrating steel angle 30 of steel top chord 20. Because of this, engineers sometimes prohibit the use of PAF's on projects.

Referring to FIG. 7B, since the top face 110 of tubular chord 102 is supported by both sidewalls 108 of the tube, a tubular chord would likely eliminate this problem, opening the door to the cost savings that comes with the speed of construction associated with PAF's. Re-work costs related to this problem would also be avoided, and the risk of a poorly fastened metal deck would be reduced. This latter benefit is also a structural stability benefit since buildings frequently depend on the corrugated metal deck for overall building stability, and proper fastening of the deck is critical to that function.

Figure 8A:
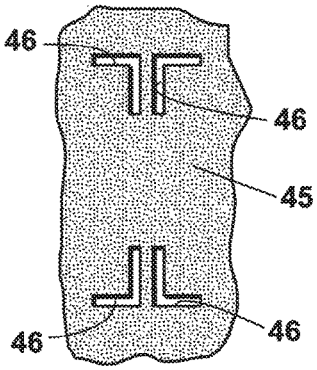
Fig. 8A ( PRIOR ART )
FIG. 8A depicts exemplary wall penetrations of the top chord and bottom chord of a conventional steel joist construction assembly.
Figure 8B:
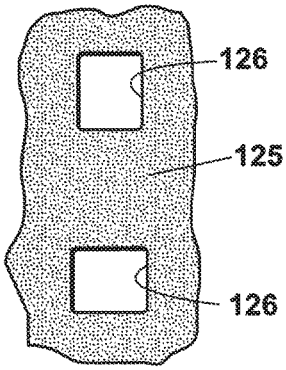
FIG. 8B depicts exemplary wall penetrations of the top chord and bottom chord of a tubular joist chord assembly of the present disclosure.

Advantage 7: Wall Penetrations:

Reference is next made to FIGS. 8A and 8B. When joist chords or diagonals in a conventional joist design (FIG. 8A) must pass through a wall 45, "L" shaped wall cutouts 46 shown in FIG. 8A are often made to accommodate the wall penetration. These cutouts 46 are expensive relative to the cutouts 126 in wall 125 required for a tubular member as depicted in FIG. 8B. Simplifying these cutouts will result in construction labor cost savings.

Figure 9:
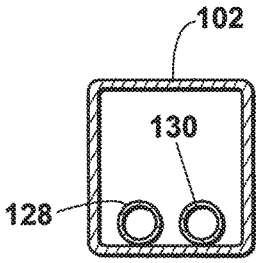
FIG. 9 depicts exemplary electrical and plumbing lines inside a tubular joist chord of the present disclosure.

Advantage 8: Electrical and Plumbing Lines:

When electrical and plumbing lines run parallel to the conventional joists that support them, clips and hangers must be used to attach those lines to the joist chord(s). A tubular joist chord provides a ready conduit for these lines 128, 130 (FIG. 9), and in a large building it would eliminate significant quantities of clips and hangers resulting in labor and material cost savings. Such an arrangement also provides the aesthetic benefit of concealing lines 128 and 130.

Advantage 9: Conditioned Air Delivery

Similar to electrical and plumbing lines 128 and 130 (FIG. 9), HVAC ductwork often runs parallel to the joists supporting it. In such cases, the tubular chord 102 is available for distributing air and if utilized, may substantially reduce the quantity of ductwork needed for the building. Again, this would lead to construction labor and material cost savings, and the aesthetic benefit of less visible ductwork.

Spliced Joist Segments.

Figure 13:
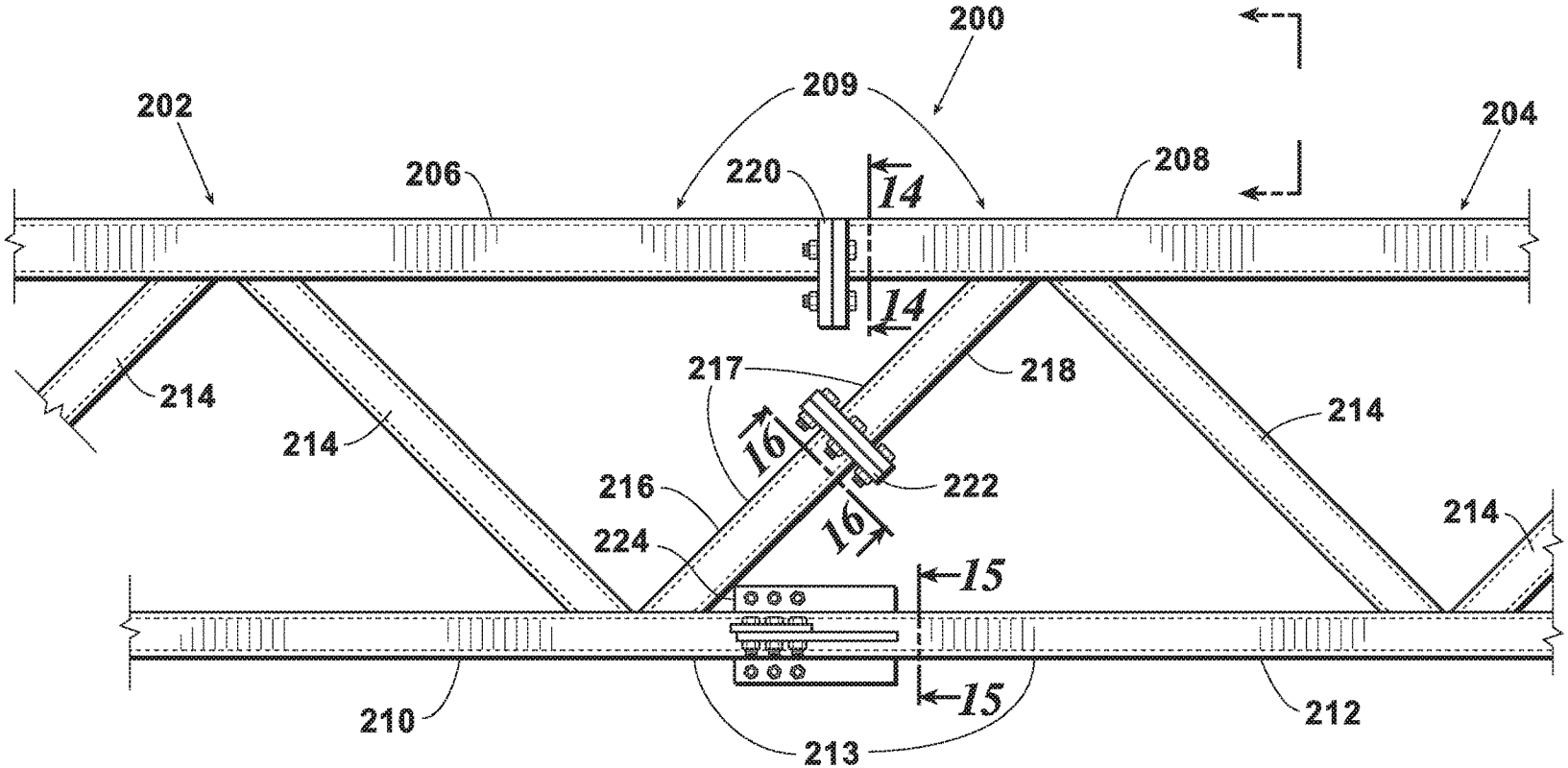
FIG. 13 depicts an exemplary joist structure of the present disclosure including two joist segments spiced together and depicts several exemplary splicing connections.

Tubular joists of short to moderate length are typically fabricated in a shop and shipped as a single unit to the field to be incorporated into a Tubular Joist Structure. Longer tubular joists that are too long to economically ship as a single unit are typically fabricated in a shop in two or more joist segments (sub-pieces) that are individually shipped and subsequently connected, or "spliced", together in the field. In this case each chord and one or more diagonals may be bifurcated by (or may include multiple segments), or augmented with, connection splice material that accommodates the splice connections that must be accomplished in the field. FIG. 13 depicts an exemplary joist with connection splice material allowing the sub-pieces to be spliced together in the field. Other variations are contemplated and would be apparent to one of ordinary skill in the art.

FIG. 13 depicts an exemplary tubular joist structure 200 of the present disclosure which is comprised of multiple joist segments which are spliced together to comprise tubular joist structure 200. In the embodiment of FIG. 13, there are two joist segments depicted 202 and 204 which are spliced together. It should be understood and apparent to one of skill in the art, however, that two, three, or more joist segments could, likewise, be spliced together in the same or similar manner as joist segments 202 and 204. Joist segments 202 and 204 each include a top sub-chord 206, and 208, respectively, such that when spliced together, form a singular tubular top chord having a continuously closed, non-adjustable length 209. Likewise, joist segments 202 and 204 each include a bottom sub-chord 210 and 212, respectively, such that when spliced together, form a singular tubular bottom chord having a continuously closed, non-adjustable length 213.

As shown in FIG. 13, joist structure 200 includes a plurality of discrete diagonal segments collectively 214 each welded and extending between the tubular top chord 209 and tubular bottom chord 213 such that tubular top chord 209 is spaced from tubular bottom chord 213 by diagonal segments 214. That said, in the spliced joist structure embodiment of FIG. 13, where joist segments 202 and 204 are spliced together, at least one diagonal 217 may be bifurcated into two sections 216 and 218 and spliced together to form joist structure 200. It should be understood that diagonal sections 216 and 218 may be, but do not have to be, of equal length depending on the location/position of the splice. In the event tubular joist structure 200 is bifurcated into additional joist segments, one or more additional diagonals may also be bifurcated.

Also as depicted in FIG. 13, joist segments 202 and 204 may be spliced together by fastening splice plates together. Three different exemplary splice assemblies 220, 222, and 224 are depicted in FIG. 13. It should be understood that alternate splice assemblies are contemplated which would be evident to one of skill in the art.

Figure 14:
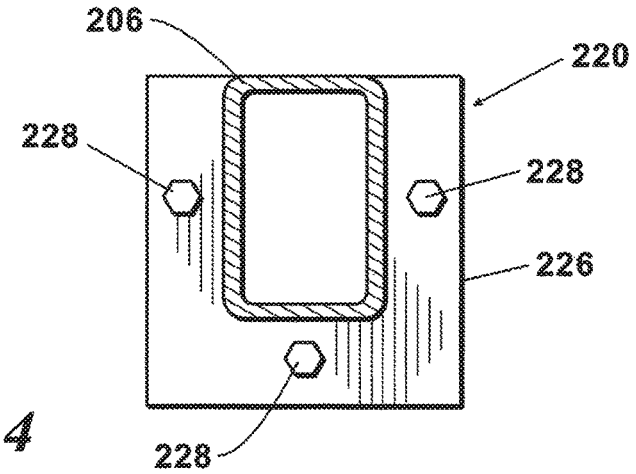
FIG. 14 depicts an exemplary splicing connection taken along line 14-14 of FIG. 13.

With reference to FIG. 14, taken in combination with FIG. 13, one exemplary splice assembly 220 is depicted. A plate such as 226 (FIG. 13) may be affixed (such as by welding) to the end of each tubular sub-chord 206 and 208 which are then bolted together with bolts 278. It should be noted that plate 226 preferably does not completely cover the end of top sub-chord 206 so that conduit may still be passed through. Additionally, in the embodiment of FIG. 14, plate 226 is designed so that it does not extend above top chord 209. This is so it does not interfere with structure which may be supported by joist structure 200, such as roof decking or the like.

Figure 15:
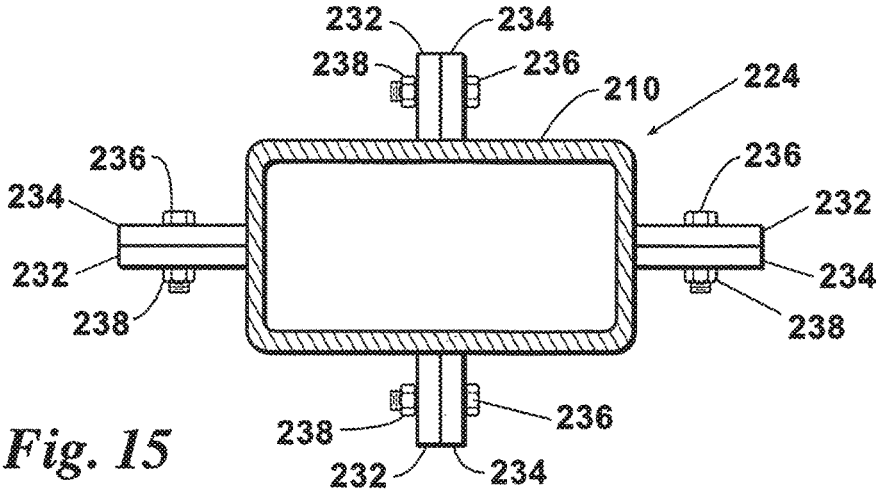
FIG. 15 depicts an exemplary splicing connection taken along line 15-15 of FIG. 13.

FIG. 15 (taken in combination with FIG. 13) depicts a further exemplary splice apparatus 224. In this exemplary apparatus, splice plates, collectively 232, are welded to one sub-chord, such as bottom sub-chord 212 in a perpendicular orientation to the respective side of sub-chord 212. In this embodiment, plates 232 extend beyond the end of sub-chord 212 and mate with plates collectively 234 which are welded in a perpendicular orientation to each side of bottom sub-chord 210. A plurality of fasteners, such as bolts collectively 236, are inserted through plates 232 and 234 and secured by nuts, collectively 238 so as to fasten plates 236 and 238 together.

Figure 16:
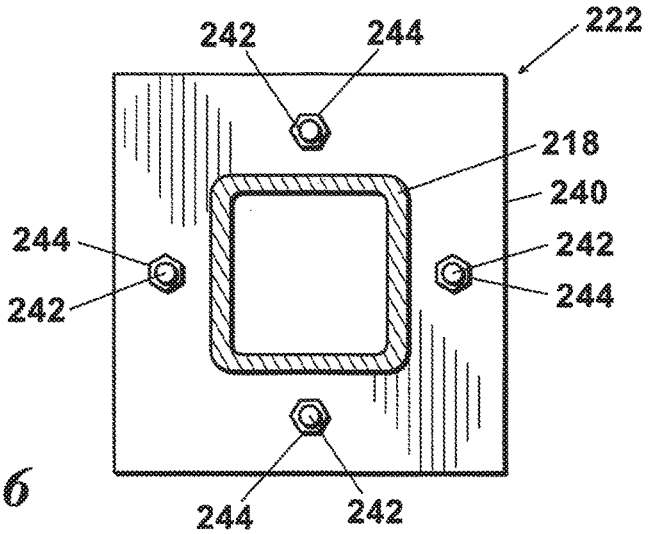
FIG. 16 depicts an exemplary splicing connection taken along line 16-16 of FIG. 13.

With reference to FIG. 16, a view taken along line 16-16 of FIG. 13, an additional exemplary splice apparatus 222 is depicted. Splice apparatus 222 is substantially the same as splice apparatus 220 of FIG. 14 with the exception that the plates, such as plate 240, extends in all directions around diagonal sections 216 and 218. A fastener, such as bolts, collectively 242 are inserted through the splice plates welded on each end of diagonal sections 216 and 218 and secured with nuts 244 so as to fasten the splice plates together and thereby splice diagonal sections 216 and 218 together to form diagonal 217.

An example calculation of estimated cost savings for the different one-story "Big Box" type buildings resulting from the use of the tubular steel joists of the present disclosure over a conventional steel joists are set forth in Table I.

TABLE I

One Story "Big Box" Type Bldg
Cost Benefit From Using Tubular LH Joists
Metal Deck Roof: 1.5B. 22 GA with 5-⅝" Puddle Welds & 8-#10 TEK Sidelap Screws

| | Measure | | |
|---|---|---|---|
| | Joists Spanning 60' | Joists Spanning 75' | Joists Spanning 90' |
| Building Size | 153,600 SF | 157,500 SF | 162,000 SF |
| Tonnage | 310 tons (181 tons of joists) | 434 tons (260 tons of joists) | 525 total tons (322 tons of joists) |
| Schedule Reduction (days) | 26 days reduced to 20 ==> 6 days | 44 days reduced to 38 ==> 6 days | 45 days reduced to 39 ==> 6 days |
| Field Savings ($) | $50,015 | $48,989 | $47,979 |
| Add'l Mat'l Costs of HSS ($) | $24,678 | $29,122 | $34,223 |
| Net Benefit ($) | $25,337 | $19,867 | $13,756 |
| Net Benefit ($/lb of joists) | $0.07 | $0.04 | $0.02 |

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. Terms of approximation (e.g., "about", "substantially", "approximately", etc.) should be interpreted according to their ordinary and customary meanings as used in the associated art unless indicated otherwise. Absent a specific definition and absent ordinary and customary usage in the associated art, such terms should be interpreted to be ±10% of the base value.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A joist structure having a span for spanning between a first support and a second support and having a center of gravity, said joist structure comprising:

a singular tubular top chord having a continuously closed, non-adjustable length;

a singular tubular bottom chord having a continuously closed, non-adjustable length;

a plurality of discrete diagonal segments each welded and extending between said tubular top chord and said tubular bottom chord such that said top chord is spaced from said bottom chord by said plurality of discrete diagonal segments;

said top chord, said diagonal segments, and said bottom chord together forming a height of the joist structure;

said joist structure spanning and configured to be secured to the first support and the second support at points that are higher than the center of gravity of the joist structure;

said length of said top chord and said length of said bottom chord together with said plurality of diagonal segments forming a secondary structural member which is dimensioned to support at least 250 pounds plus a 20% contingency for a total weight of 300 pounds located anywhere along the joist without requiring any erection bracing or bridging for a span of at least 24 times the height of the joist structure.

2. The joist structure of claim 1 further comprising:

said top chord having a bottom surface;

at least one doubler plate welded to said bottom surface of said top chord.

3. The joist structure of claim 2 wherein at least one of said diagonal segments is welded to a doubler plate.

4. The joist structure of claim 1 further comprising:

said bottom chord having a top surface;

at least one doubler plate welded to said top surface of said bottom chord.

5. The joist structure of claim 4 wherein at least one of said diagonal segments is welded to a doubler plate.

6. The joist structure of claim 1 further comprising:

said top chord having a bottom surface;

at least one doubler plate welded to said bottom surface of said top chord;

said bottom chord having a top surface;

at least one doubler plate welded to said top surface of said bottom chord.

7. The joist structure of claim 6 wherein at least one of said diagonal segments are welded to a doubler plate.

8. A joist structure having a span for spanning between a first support and a second support and having a center of gravity, said joist structure comprising:

a singular tubular top chord tube having a continuously closed, non-adjustable length;

a singular tubular bottom chord tube having a continuously closed, non-adjustable length;

a plurality of discrete diagonal segments each welded and extending between said tubular top chord and said tubular bottom chord such that said top chord is spaced from said bottom chord by said plurality of discrete diagonal segments;

said top chord, said diagonal segments, and said bottom chord together forming a height of the joist structure;

said joist structure spanning and configured to be secured to the first support and the second support at points that are higher than the center of gravity of the joist structure;

said length of said top chord and said length of said bottom chord together with said plurality of diagonal segments forming a secondary structural member which is dimensioned to support at least 250 pounds located anywhere along the joist without requiring any erection bracing or bridging for a span of at least 24 times the height of the joist structure;

the joist structure including at least two joist segments spliced together.

9. The joist structure of claim 8 wherein at least one of said plurality of said diagonals is tubular.

10. The joist structure of claim 8 wherein substantially all of said plurality of said diagonals are tubular.

11. The joist structure of claim 9 wherein said plurality of diagonals are arranged in a zig-zag formation between said tubular top chord and said tubular bottom chord.

12. The joist structure of claim 8 wherein said at least two joist segments are spliced together by fastening together splice plates affixed to adjoining ends of said at least two joist segments.

13. A plurality of joist structures of claim 8 aligned substantially parallel to form an assembly capable of supporting a structural element.

14. The joist structure of claim 8 wherein said tubular top chord is capable of receiving a power actuated fastener.

15. The joist structure of claim 9 wherein said tubular top chord or said tubular bottom chord are capable of receiving a utility conduit.

16. A method of constructing a joist structure capable of supporting a structural element, comprising:

assembling a joist segment including a singular top sub-chord and a singular bottom sub-chord, by welding a plurality of tubular diagonal segments between said top sub-chord and said bottom sub-chord;

said plurality of tubular diagonal segments each including a first open end and a second open end wherein said first open end is welded to said top sub-chord or a doubler plate and said second open end is welded to said bottom sub-chord or a doubler plate;

splicing said at least two joist segments to form the joist structure;

said joist structure including a continuously closed tubular top chord tube having a cross-section of constant outside perimeter length and shape and a continuously closed tubular bottom chord tube having a cross-section of constant outside perimeter length and shape;

said joist structure forming a secondary structural member; and, a length of said top chord and a length of said bottom chord together with said plurality of diagonal segments forms the secondary structural member which is dimensioned to support at least 250 pounds located anywhere along the joist without requiring any erection bracing or bridging for a span of at least 24 times a height of the joist structure.

17. The method of claim 16 wherein at least one of said diagonal segments being bifurcated; and, splicing said at least one diagonal segment together.

18. The method of claim 16 wherein substantially all of said plurality of said diagonals are tubular.

19. The method of claim 17 including assembling a plurality of joist structures to form the secondary structural member.

20. The joist structure of claim 8 further comprising:

said top chord having a bottom surface;

at least one doubler plate welded to said bottom surface of said top chord;

said bottom chord having a top surface;

at least one doubler plate welded to said top surface of said bottom chord;

at least one of said diagonal segments welded to a doubler plate.

* * * * *